US007377466B1

(12) United States Patent
Smith

(10) Patent No.: US 7,377,466 B1
(45) Date of Patent: May 27, 2008

(54) PROPULSION SYSTEM FOR MINIATURE VEHICLES

(76) Inventor: Joseph James Smith, 2410 Crescent Dr., La Porte, TX (US) 77571

( * ) Notice: Subject to any disclaimer, the term of this patent is extended or adjusted under 35 U.S.C. 154(b) by 138 days.

(21) Appl. No.: 11/103,989

(22) Filed: Apr. 12, 2005

(51) Int. Cl.
*B64D 35/00* (2006.01)

(52) U.S. Cl. ..... 244/60; 244/55; 446/57; 416/111

(58) Field of Classification Search ..... 244/153 R, 244/54, 55, 17.11, 13, 60; 446/34, 232, 36, 446/37; 416/111; 60/904
See application file for complete search history.

(56) References Cited

U.S. PATENT DOCUMENTS 2,310,220 A * 2/1943 Michelis ..... 74/661
3,946,706 A * 3/1976 Pailler ..... 123/54.2
5,765,512 A * 6/1998 Fraser ..... 123/54.1
6,062,176 A * 5/2000 Berger ..... 123/54.1
6,412,454 B1 * 7/2002 Green ..... 123/54.1
6,568,980 B2 * 5/2003 Barthold ..... 446/36
6,769,384 B2 * 8/2004 Dougherty ..... 123/54.1
6,895,835 B2 * 5/2005 Cordeiro ..... 74/665 A
7,011,275 B2 * 3/2006 Redfern ..... 244/60

* cited by examiner

*Primary Examiner*—Michael J. Carone
*Assistant Examiner*—Benjamin P Lee
(74) *Attorney, Agent, or Firm*—Karen B. Tripp; Elizabeth Layman

(57) ABSTRACT

A propulsion system for miniature vehicles, such as model airplanes, having multiple direct-current motors arranged radially about a central axis of the propulsion system that drive a propeller system.

8 Claims, 3 Drawing Sheets

PROPULSION SYSTEM FOR MINIATURE VEHICLES

FIELD OF THE INVENTION

This invention relates to a propulsion system for miniature vehicles. More particularly, the invention relates to an electric-powered propulsion system for miniature vehicles such as aircraft.

BACKGROUND OF THE INVENTION

The popularity of the radio-control hobby, as it applies to miniature or model aircraft, cars, boats and miniature military vehicles, has seen dramatic growth in recent years. Advancements in electric power technology, such as the increase in power-to-weight ratio of electric motors and batteries, have encouraged interest in the hobby for all age groups.

Today's radio-controlled models are less expensive and can be purchased almost ready-to-fly. They are typically made of molded foam in attractive colors with motors and control equipment pre-installed.

An important factor in the use of electric propulsion is the extreme quietness of the units. Noise pollution is almost non-existent so electric models can be flown at almost any park, school ground or ball field.

Most recently the challenges of electric flight have diminished to the point that it has become a common form of propulsion for all types of miniature aircraft.

All electric, radio-controlled models utilize a single motor or multiple single motor configurations. No electric powered multiple radial type motor is currently available.

It is the intent of this invention to provide a propulsion system that can be used on model airplanes.

It is a further intent of this invention to provide a propulsion system that allows a scale-like, electric motor to power models of World War I and II vintage aircraft. There are many examples of these aircraft such as English Sopwith Camels, German Fokker Tri-planes and a vast selection of United States bi-plane trainers, fighter planes and civilian aircraft. All of the above examples sold to the public at this time use single motor configurations.

It is the intent of this invention to offer an electric radial propulsion system that is powerful and offers the additional advantage of scale-like appearance and sound.

It is a further intent of this invention to provide a multiple-cylinder, electric, radial motor propulsion system that is configured to power miniature vehicles, such as model planes, at a scale-like speed that is safe, quiet, durable and economical to operate and that enhances the appearance of any scale-type model by more closely duplicating the original full-scale round-looking type of engine.

SUMMARY OF THE INVENTION

This invention is a propulsion system for use in a miniature vehicle having a motor assembly comprised of a plurality of direct current motors operating together and arranged radially from a central axis of the motor assembly

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENT

Figure 1A:
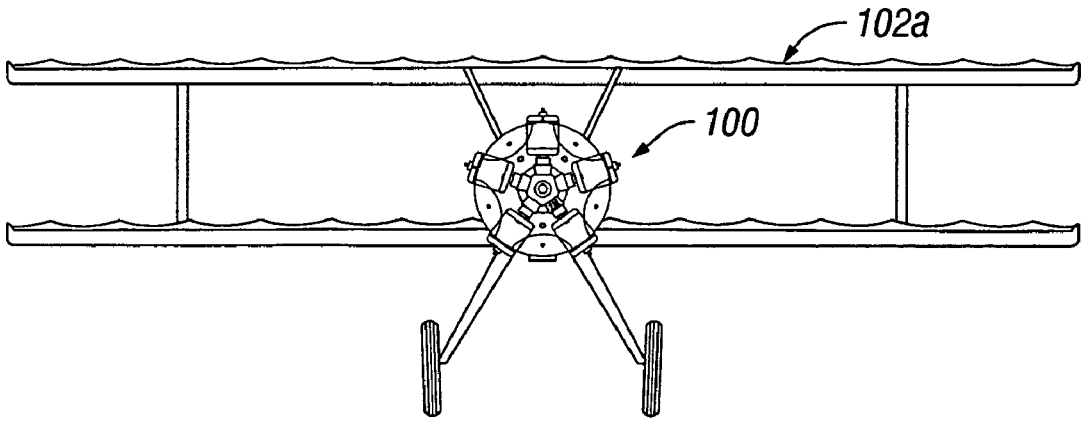
FIG. 1*a* is a frontal view of the propulsion system of the present invention, as mounted on one type of a miniature aircraft, with the propeller cutaway.

Referring now to the drawings, it is noted that like reference characters designate like or similar parts throughout the drawings. The figures, or drawings, are not intended to be to scale. For example, purely for the sake of greater clarity in the drawings, wall thicknesses and spacings are not dimensioned as they actually exist in the assembled embodiments.

Figure 1B:
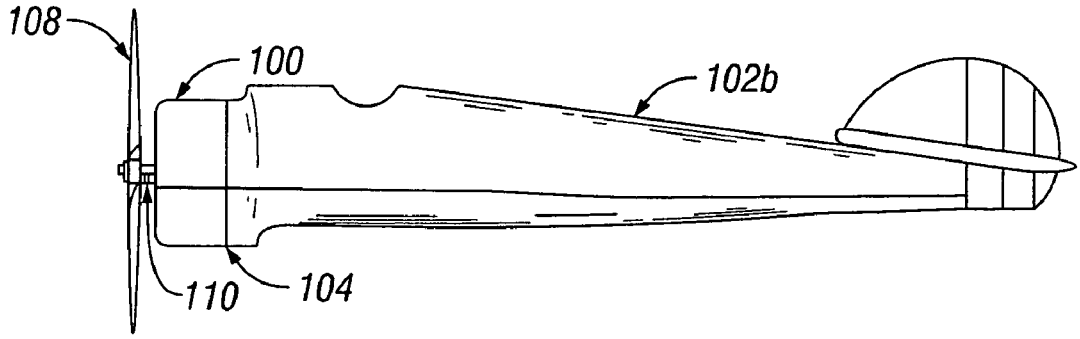
FIG. 1*b* is a side view of the propulsion system of FIG. 1*a* installed on a different type of a miniature aircraft, with the propeller in place.

FIG. 1*a* is a frontal view of a propulsion system 100 of a preferred embodiment mounted on a miniature aircraft 102*a*. FIG. 1*b* is a side view of propulsion system 100 mounted on the front of the aircraft 102*b* by attaching the propulsion system 100 to a firewall 104 in the aircraft 102*b*.

Figure 2:
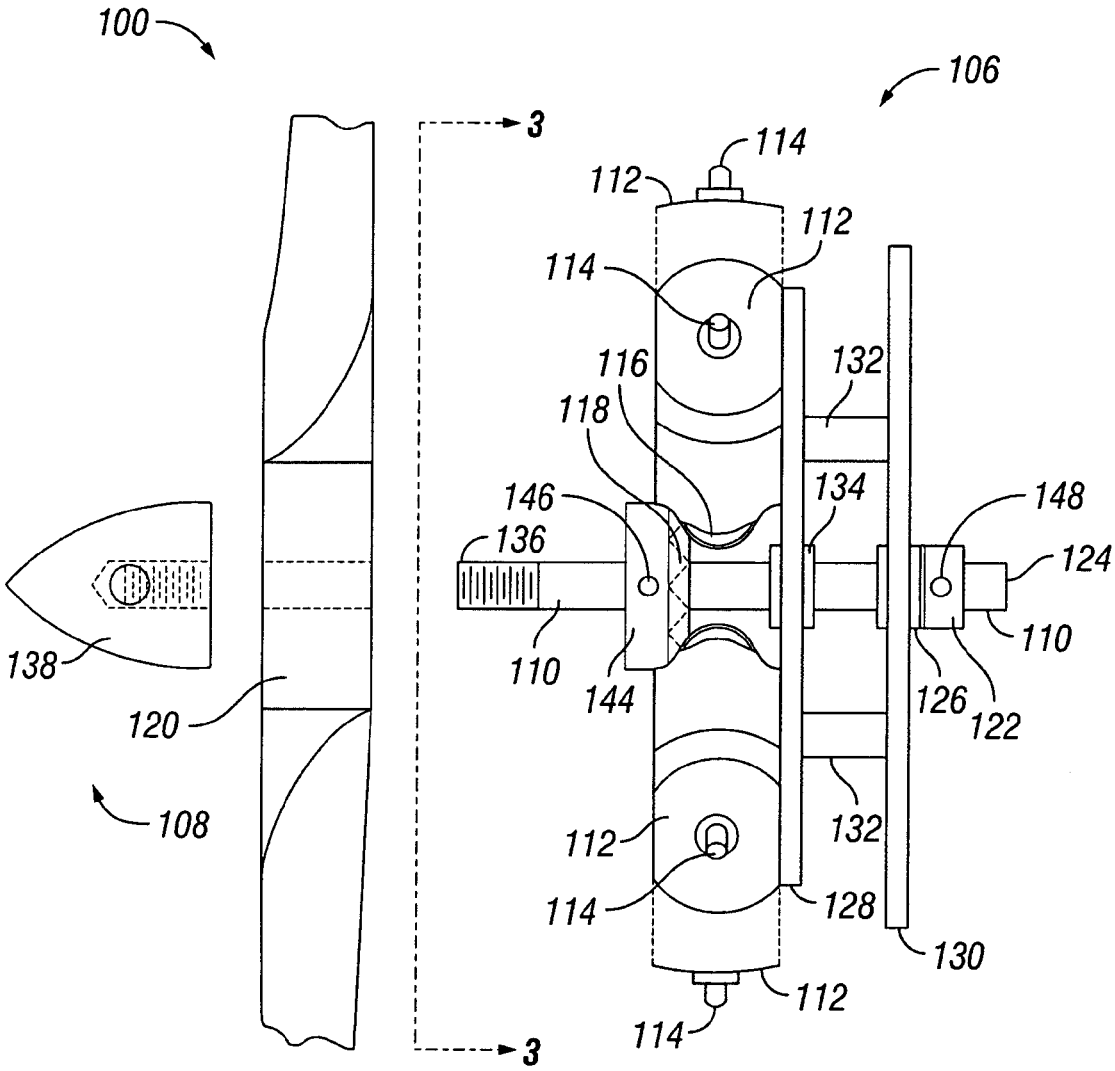
FIG. 2 is a partially-exploded side view of the propulsion system showing the propeller assembly, the motor assembly and the drive shaft of the present invention.

The propulsion system 100 of the preferred embodiment includes the elements shown in FIG. 2. The details of the preferred embodiment are discussed below and include a motor assembly 106 and a propeller assembly 108 connected together with a drive shaft 110.

Figure 3:
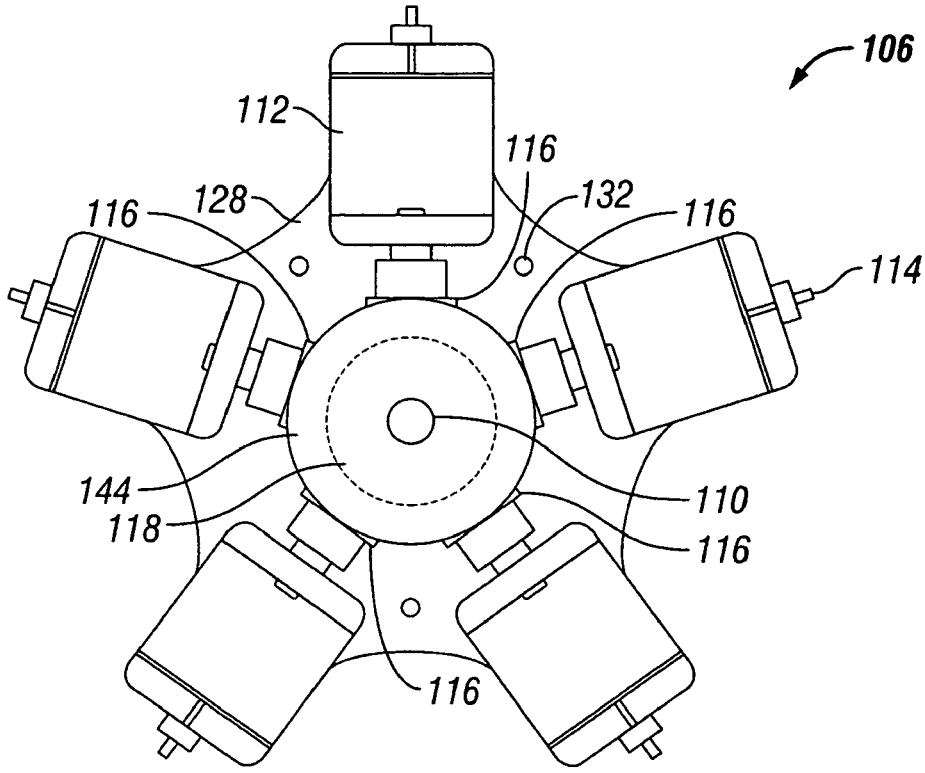
FIG. 3 is a front view of the motor assembly of the present invention along lines A-A' of FIG. 2.

As shown in the front view in FIG. 3, the motor assembly 106 of the preferred embodiment utilizes five, small, approximately 3-7 volt direct current electric motors 112 configured in a symmetrical pattern that is radially disbursed from the drive shaft 110 which is the axis of the motor assembly 106. The motors must be configured properly for the voltage, weight, torque and amperage specifications of the desired unit. The five-unit embodiment is meant by way of example and is not intended to limit the scope of the invention.

This radial motor configuration emulates the advantage of the fly-wheel effect produced by a large propeller (not shown). This effect is what develops the maximum power of the motor assembly 106 and allows the aircraft 102*a* and 102*b* to fly. This phenomenon also is evident in full-scale aircraft designed with radial engines (not shown). Conversely, increasing the voltage and RPM has little effect on power output and only serves to use more energy.

Figure 4:
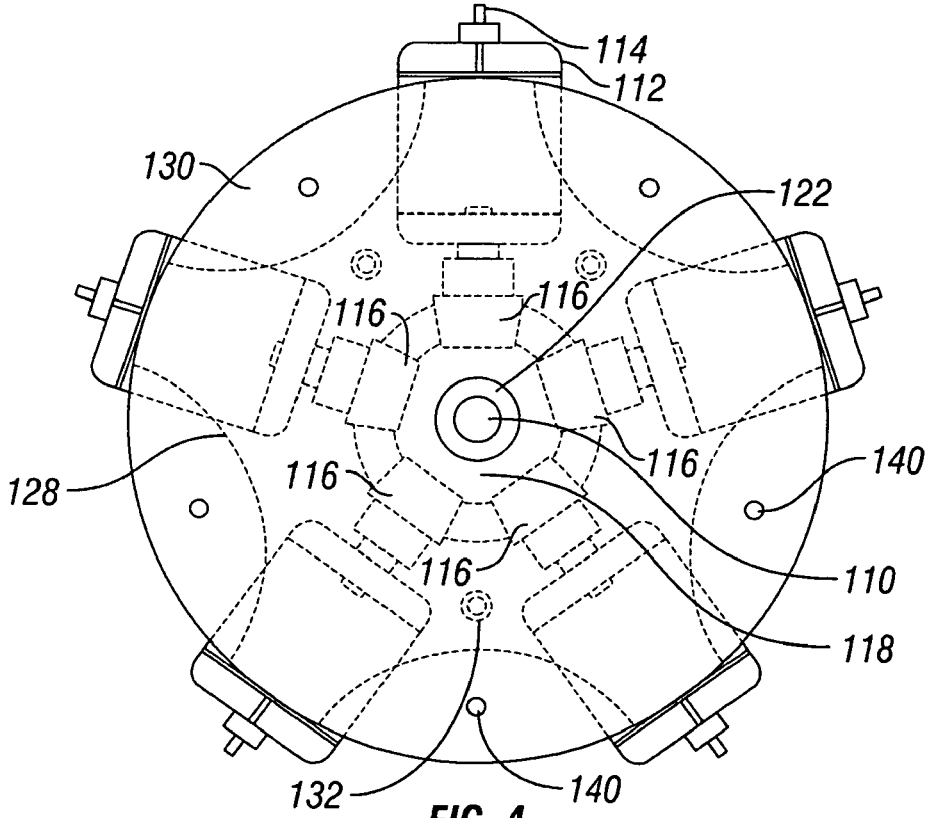
FIG. 4 is a rear view of the motor assembly of the present invention.

The dimensions of the individual motors 112 in this preferred embodiment are approximately 1⅜" long by 1" wide with about a ⅜" long by 2 mm diameter motor shaft 114. The top and bottom of the individual motors 112 are approximately flat which makes the height of the motors 112 approximately ¾". Cylindrical motors (not shown) of approximately the same size and power requirements also can be used. All dimensions are meant by way of example and are not meant to limit the scope of the invention As shown in FIGS. 2, 3 and 4, each DC motor 112 has approximately a ½ inch diameter, 45-degree pinion gear 116 pressed onto the respective motor 112. All of the pinion gears 116 mate to a main gear 118. The main gear 118 is about 1½ inches in diameter. The final gear ratio (pinion to main gear) is 3:1 and turns a 14-inch diameter by 10-inch pitch propeller 120 approximately 2300 RPM. This produces about 12.9 ounces of thrust at a 3.9 ampere draw from a 12-volt flight battery (not shown). This 3:1 ratio is critical to the proper rotational speed of the propeller 120, which is targeted for optimum flight time and power.

The main gear 118 and the pinion gears 116 can be made of nylon, plastic or other light-weight, non-conductive material. Only a slight amount of lubricant (not shown) is required for the main gear 118 and the pinion gears 116. Typically, one small drop is sufficient for every ten flights.

As illustrated in FIG. 2, FIG. 3, and FIG. 4, the 45-degree configuration of the main gear 118 and the pinion gears 116 allows the motors 112 to be mounted flat and in a radial arrangement around the main gear 118, with the motor shafts 114 of the motors 112 positioned perpendicular to the drive shaft 110. This mounting configuration replicates a full-scale aircraft engine (not shown). Additionally, having the main gear 118 mounted forward of the pinion gears 116 provides a way to easily adjust the pinion-to-main gear clearance. The clearance is set by simply sliding the propeller assembly 108 and the main gear 118 forward and off the pinion gears 116 and inserting a strip of material of known thickness, such as a common business card, to set the clearance at the desired depth of 0.005-0.008 inches. Proper gear spacing is important to reduce drag.

The gear clearance is locked in place by a thrust collar 122 at the distal end 124 of the drive shaft 110. The thrust collar 122 is pinned to the drive shaft 110 by a set screw 148 and rides on a thrust washer 126. It serves to secure the drive shaft 110 to a front mounting plate 128 and a rear mounting plate 130. The rear mounting plate 130 has equally-spaced mounting holes 140 (FIG. 4) around the edge of the plate 130 to allow screws (not shown) to pass through the rear mounting plate 130 to mount the propulsion system 100 to the firewall 104 in the aircraft 102*a* or 102*b*.

In the preferred embodiment, the front mounting plate 128 (FIG. 3 and FIG. 4) is designed in a star configuration and allows airflow around the motors 112 to facilitate cooling. As shown in FIG. 2, the rear mounting plate 130 is separated from the front mounting plate 128 by 2 inch plate supports (spacers) 132. This separation or clearance between the front mounting plate 128 and the rear mounting plate 130 increases cooling by providing additional airflow space around the motors 112 and provides space for the separation of drive shaft bearings 134. This space between the front mounting plate 128 and the rear mounting plate 130 strengthens the entire motor assembly 106 and separates the drive shaft bearings 134 for precise alignment of the drive shaft 110.

The front mounting plate 128 and the rear mounting plate 130 can be made of plywood or molded from plastic or other light-weight, non-conductive, rigid and durable material.

The dimensions of the drive shaft 110 are approximately ¼ inch by 3 inches. The drive shaft 110 can be made of nylon, plastic or other durable, light-weight, non-conductive material. The propeller 120 is mounted at the proximal end 136 of the drive shaft 110 and is secured to a propeller hub 144 by a spinner nut 138 (¼ inch by twenty-eight threads per inch). The spinner nut 138 can be made of plastic, aluminum or other similarly featured material. Propellers 120 are commonly available and are frequently made of wood or molded plastic.

The propeller hub 144 is positioned on the drive shaft 110 between the propeller 120 and the main gear 118 and rotates in synchronization with the propeller 120. The propeller hub 144 is pinned to the drive shaft 110 by a pin 146.

All wiring (not shown) is pre-installed to each motor terminal and can be color-coded for positive and negative polarity. An electrical connector can be soldered to the end of the motor wires for connecting to an electronic throttle control device (not shown) provided by the kit manufacturer or consumer.

The propulsion system 100 can be easily installed on many ready made and quick-assembly kits for miniature aircraft 102*a* and/or 102*b* for example as shown in FIG. 1. Short screws (not shown) are used to connect the propulsion system 100 to the aircraft firewall 104. The flight transmitter (not shown) sends commands to the electronic throttle control device (not shown) that controls the throttle on/off and power setting of the propulsion system 100.

The flight batteries (not shown) are quick charged from a 12-volt field battery (not shown) or automobile batteries (not shown) on site. Many 800 milliamp flights can be made during the normal flying session.

Flight duration with a typical 30-inch span bi-plane (FIG. 1*a*) with 400-500 square inches of wing area, weighing 28 ounces, will typically last about 20-30 minutes. However, exact flying time depends on the amount of aerobatics performed and throttle setting, wind speeds and other factors. The motors 112 also can be wired in parallel (not shown) for more power but less flight time.

It is anticipated that those skilled in the art of motors will recognize various other ways of practicing the invention and other uses of the invention. While the invention has been particularly shown and described with reference to the preferred embodiment thereof, it will be understood by those skilled in the art that various changes in form and detail may be made therein without departing from the scope of the invention, as set forth in the following claims.

The invention claimed is:

1. A propulsion system sized for use in a radio controlled miniature vehicle, comprising a motor assembly further comprised of a plurality of direct-current (DC) motors operating cooperatively and arranged radially from the central axis of the motor assembly, which provides propulsion to said miniature vehicle, wherein each said DC motor has a motor shaft positioned perpendicular to said central axis.

2. The propulsion system of claim 1, wherein the miniature vehicle is a model airplane.

3. The propulsion system of claim 2, further comprising a propeller system and a drive shaft.

4. The propulsion system of claim 3, wherein the plurality of DC motors comprises five DC motors.

5. The propulsion system of claim 4 further comprising:

a front mounting plate having an aperture for receiving the drive shaft, wherein the DC motors are arranged radially on the front mounting plate, and wherein the drive shaft is the central axis of the radial disbursement of the DC motors, wherein each of the DC motors further comprises a pinion gear at the end towards the drive shaft, a main gear having an aperture for receiving the drive shaft, wherein the main gear is positioned on the drive shaft in front of the DC motors and mated with the pinion gears of the DC motors;

wherein the motor assembly is attached to the propeller system via the drive shaft and to the miniature aircraft.

6. The propulsion system of claim 5, further comprising a rear mounting plate having an aperture for receiving the drive shaft, wherein the rear mounting plate is positioned on the drive shaft behind the front mounting plate; and wherein the motor assembly is attached to the miniature aircraft via the rear mounting plate.

7. The propulsion system of claim 6 wherein said pinion gear of each motor is a 45-degree pinion gear which enables the perpendicular positioning of the motor to the central axis/drive shaft.

8. The propulsion system of claim 7 wherein said front mounting plate has a star configuration allowing airflow around the motors.

* * * * *